US007733028B2

(12) United States Patent
Chen et al.

(10) Patent No.: US 7,733,028 B2
(45) Date of Patent: Jun. 8, 2010

(54) METHOD AND SYSTEM FOR ELIMINATING DC BIAS ON ELECTROLYTIC CAPACITORS AND SHUTDOWN DETECTING CIRCUIT FOR CURRENT FED BALLAST

(75) Inventors: Timothy Chen, Aurora, OH (US); Hailiang Miao, ShangHai (CN); Nitin Kumar, Mayfield Heights, OH (US)

(73) Assignee: General Electric Company, Schenectady, NY (US)

( * ) Notice: Subject to any disclaimer, the term of this patent is extended or adjusted under 35 U.S.C. 154(b) by 386 days.

(21) Appl. No.: 11/934,943

(22) Filed: Nov. 5, 2007

(65) Prior Publication Data

US 2009/0115340 A1 May 7, 2009

(51) Int. Cl.
*H05B 41/00* (2006.01)

(52) U.S. Cl. ..... 315/123

(58) Field of Classification Search ..... None
See application file for complete search history.

(56) References Cited

U.S. PATENT DOCUMENTS

| | | | | |
|---|---|---|---|---|
| 4,347,558 | A | 8/1982 | Kalinsky | |
| 5,253,157 | A | 10/1993 | Severinsky | |
| 5,635,799 | A | 6/1997 | Hesterman | |
| 5,737,207 | A | 4/1998 | Uratani et al. | |
| 6,856,100 | B1 | 2/2005 | Konopka | |
| 7,193,368 | B2 | 3/2007 | Chen et al. | |
| 7,315,130 | B1 * | 1/2008 | Chen et al. | 315/127 |
| 7,336,513 | B1 | 2/2008 | Chen et al. | |
| 2006/0103317 | A1 * | 5/2006 | Chen et al. | 315/98 |

FOREIGN PATENT DOCUMENTS

| | | |
|---|---|---|
| EP | 0 881 864 B1 | 12/1988 |
| FR | 2 627 342 | 8/1989 |
| WO | WO 03/088722 A1 | 10/2003 |

OTHER PUBLICATIONS

PCT/US2008/078106 International Search Report, mailed Dec. 23, 2008.
U.S. Appl. No. 11/645,939, filed Dec. 27, 2006, Chen et al.

* cited by examiner

*Primary Examiner*—Douglas W Owens
*Assistant Examiner*—Jianzi Chen
(74) *Attorney, Agent, or Firm*—Fay Sharpe LLP

(57) ABSTRACT

A system and method is provided that eliminates DC bias on at least one of a first electrolytic capacitor and a second electrolytic capacitor of a bipolar junction transistor (BJT) based inverter ballast having a shutdown control circuit in association with only one of at least two BJT switches. A duty cycle dependent capacitor is connected in a series with a bus of the ballast, and a resonant circuit, including primary winding of the output transformer and a resonant capacitor. A balancing/charging resistor is connected at one end between the first electrolytic capacitor and the second electrolytic capacitor, and at another end to the duty cycle dependent capacitor and the resonant circuit.

14 Claims, 2 Drawing Sheets

METHOD AND SYSTEM FOR ELIMINATING DC BIAS ON ELECTROLYTIC CAPACITORS AND SHUTDOWN DETECTING CIRCUIT FOR CURRENT FED BALLAST

BACKGROUND OF THE INVENTION

The present application is directed to lighting devices, and more particularly to ballast circuitry for discharge lamps.

Electronic ballasts utilize electronic circuitry to stabilize current for fluorescent lamps, high-intensity discharge lamps, and the like. Electronic ballasts may be started using one of several starting techniques, including "instant" start, "rapid" start, and "programmed" start. The instant start technique starts a lamp in the short term, because it starts and operates the ballast without preheating a cathode associated therewith, which results in low cost in ballast design but wears out the lamp more rapidly than other starting protocols due to the violent nature of the starting method. The rapid starting technique starts the ballast and heats the cathode concurrently, resulting in a relatively long start time while mitigating the deleterious effects of a cold start on the lamp's cathode. Finally, the programmed start technique employs a cathode preheating period at low glow discharge current which increases the lamp's life for frequency switching applications.

Description of a ballast which includes an instant program start configuration for use with parallel lamps has been set forth in U.S. Pat. No. 7,193,368, titled, Parallel Lamps With Instant Program Start Electronic Ballast, to Chen et al., issued Mar. 20, 2007. This ballast takes advantage of the beneficial aspects of a program start ballast (e.g., longer lamp life) and combines it with the advantages of an instant start ballast (e.g., quick start time) to produce an improved lamp ballast wherein parallel lamps are driven.

U.S. application Ser. No. 11/645,939, titled, Switching Control For Inverter Startup And Shutdown, filed Dec. 27, 2006, which includes a low cost shutdown circuit.

Both U.S. Pat. No. 7,193,368 to Chen et al., and U.S. application Ser. No. 11/645,939 to Chen et al. are both hereby incorporated by reference in their entireties.

Drawbacks such as described above, which have startup and shutdown circuitry, are that the shutdown control circuitry acts on only one of the bipolar junction transistor (BJT) switches. Therefore, when the complete turnoff of that particular BJT switch does not occur in a short time interval, an imbalance will exist on series connected electrolytic capacitors of the ballast. As a result of the imbalance, one of the two series electrolytic capacitors of the ballast is subject to overvoltage, leading to the failure of the overloaded capacitor.

BRIEF DESCRIPTION OF THE INVENTION

A system and method is provided that eliminates DC bias on at least one of a first electrolytic capacitor and a second electrolytic capacitor of a bipolar junction transistor (BJT) based inverter ballast having a shutdown control circuit in association with only one of at least two BJT switches. A duty cycle dependent capacitor is connected in a series with a bus of the ballast, and a resonant circuit, including primary winding of the output transformer and a resonant capacitor. A balancing/charging resistor is connected at one end between the first electrolytic capacitor and the second electrolytic capacitor, and at another end to the duty cycle dependent capacitor and the resonant circuit.

DETAILED DESCRIPTION OF THE INVENTION

In accordance with various aspects and features described herein, systems and methods are presented that facilitate elimination of DC bias on an electrolytic capacitor of an current fed based electronic ballast circuit with shutdown control on one of the switching device (BJT), and to provide a shutdown detecting circuit for such electronic ballast.

Bi-level control has become popular for high intensity discharge (HID) lamp systems due to its simplicity and energy cost-efficiency. This control has also gained popularity for fluorescent discharge lighting systems with electronic ballasts due to high energy savings at low cost. According to various features, a current-fed self-oscillating instant program start ballast is described, such as may be utilized in a number of lamp lighting systems, including but not limited to T5 lamp applications, and is designed in a manner that mitigates problems associated with conventional integrated circuit (IC) controlled ballasts, which tend to be expensive and less reliable.

Figure 1:
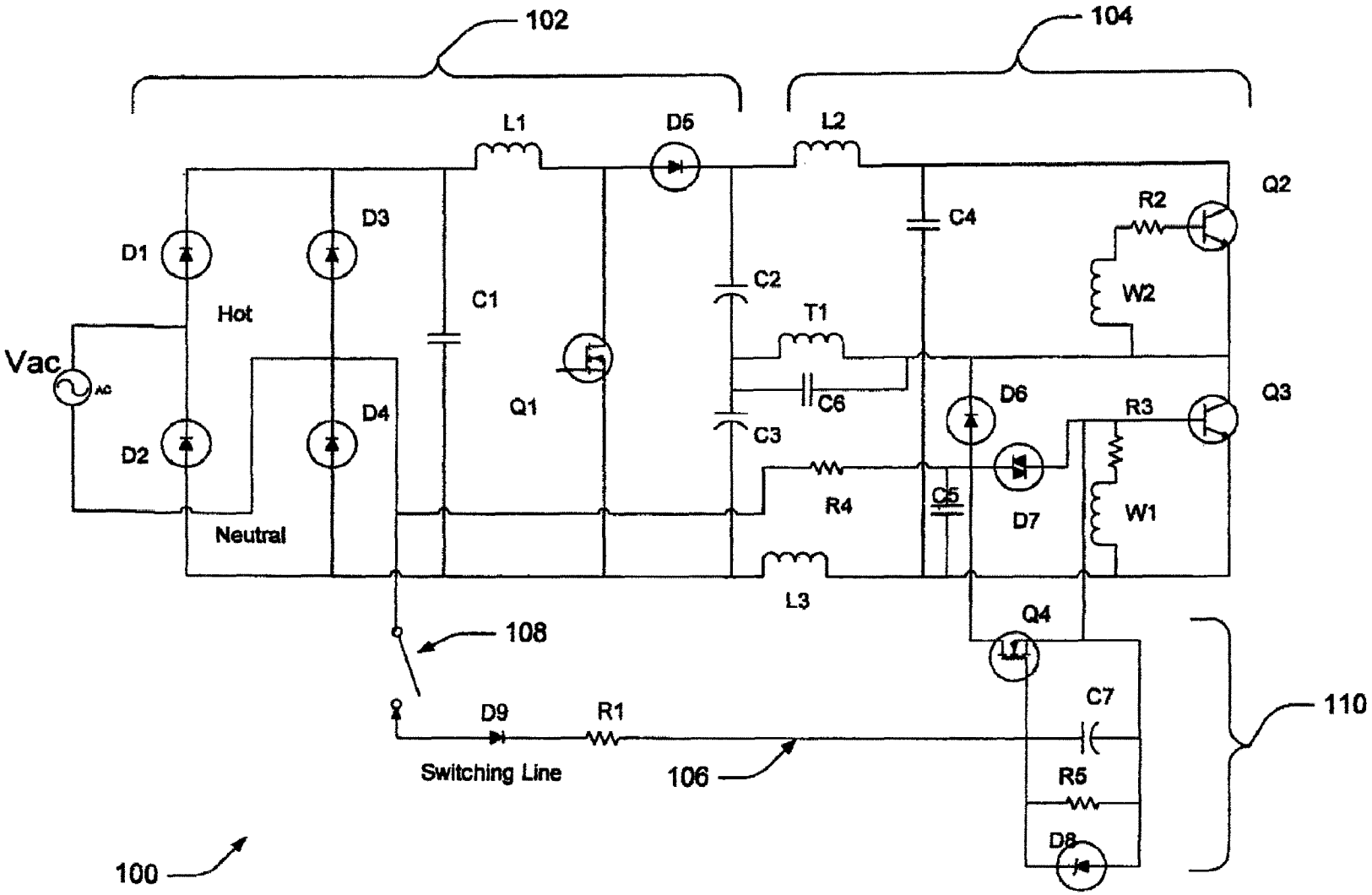
FIG. 1 illustrates an current fed based electronic ballast in which the concepts of the present application may be implemented.

With reference to FIG. 1, a schematic diagram of a ballast topography 100 is illustrated, wherein the ballast permits bi-level control for a lighting system by providing a line control step-level switching mechanism for the ballast 100. For instance, in a scenario in which it is desirable to turn off a lamp/inverter for energy savings, such as in a room in which no occupants are present, ballast 100 may facilitate lamp shut-off. The ballast 100 may be utilized in conjunction with a T5 discharge lamp, as well as other size discharge lamps, including but not limited to T8, T4, T3, T2, or any other size lamp in which line control step-level switching is desired. The ballast 100 comprises an input and power factor control (PFC) portion 102 comprising a first set of components, and an inverter portion 104. The input-PFC portion 102 includes a full-bridge rectifier (D1-D4), inductor L1, diode D5, capacitors C1, C2, C3, and switch Q1. The inverter portion 104 includes switching portions (Q2, R2, W2) and (Q3, R3, and W1), as well as capacitors C4, C5, C6, inductors L2, L3, diode D6, diac D7, resistor R4, and winding T1.

The PFC 102 and inverter 104 are coupled by a switching line 106 that facilitates triggering a shutdown/restart mechanism in accordance with various aspects. For instance, a switch 108 in switching line 106 may be triggered by a remote sensor (not shown), such as a motion sensor or the like, which detects a presence or absence of an occupant in an area that is illuminated by one or more lamps associated with ballast 100. When the motion sensor is activated, the switch 108 may be in an open state to permit the ballast to operate normally. When the motion sensor is not activated (e.g., when no occupants are detected), the switch 108 may be triggered to close, resulting in an initiation of the aforementioned events.

For instance, upon applying input power to ballast 100, capacitor C5 is charged up by resistor R4. When a voltage across C5 reaches a breakdown voltage of diac D7, a high di/dt current is applied to base drive winding W1 to initiate inverter oscillation. A diode D6 discharges capacitor C5 when Q3 is on. In accordance with various aspects, Q3 may be a bipolar junction transistor (BJT). A low-voltage MOSFET Q4 is connected in parallel with diac D7. Zener diode D8, resistor R5 and capacitor C7 are in parallel and connected from gate to source of Q4. A resistor R1 (in series with diode D9) is connected to one end of the switching line 106, and the other end of the switching line 106 is connected either to a "Neutral" or a "Hot" input line.

When switch 108 in switching line 106 is in an "off" position (e.g., switch 108 is open), there is no voltage developed across Q4 gate-to-source of a trigger circuit 110. Therefore, switch Q4 is the off position, and current-fed inverter 104 is in a normal operating condition. When switching line 106 is on (or off in a case where reverse logic is utilized), the half-rectified input voltage will be scaled down and the averaged voltage is applied to the gate-to-source of switch Q4. This voltage turns on Q4 and puts capacitor C5 in parallel with winding W1 and resistor R3. The capacitor C5 effectively bypasses the base drive current away from Q3, and the inverter oscillation stops. At the same time, switch Q4 prevents a voltage build up on capacitor C5 from startup resistor R4. Upon opening switch 108 on switching line 106, the gate-to-source voltage of switch Q4 drops and switch Q4 turns off, allowing capacitor C5 to charge by resistor R4 at which point, the breakdown of diode D7, the inverter restarts and ballast operation resumes.

Thus, upon applying power to the ballast 100 (e.g., turning on a light switch connected thereto), the PFC section 102 is operational. Current traversing resistor R4 charges up capacitor C5. Once the voltage on capacitor C5 reaches a breakdown point of diac D7, the diac D7 breaks down and a high current (di/dt) is applied to the base of Q3, which turns on Q3. During a subsequent half-cycle of an applied voltage waveform, Q2 turns on and Q3 turns off. This sequence may repeat every half cycle with switches Q2 and Q3 alternating respective on and off states. Whenever switch Q3 turns on, capacitor C5 begins to discharge because D6 is conducting. However, when switch Q3 turns off the capacitor C5 is charging. Because the time constant associated with capacitor C5 is longer than the half-cycle period for which switch Q3 is in the off state, the voltage on C5 does not reach the breakdown voltage of the diac D7. By positioning capacitor C5 in parallel with the base drive winding W1 of Q3, current through the base of Q3 is reduced, thereby turning Q3 off and shutting down its portion of the circuit, and thus the ballast 100 shuts down as well.

Figure 2:
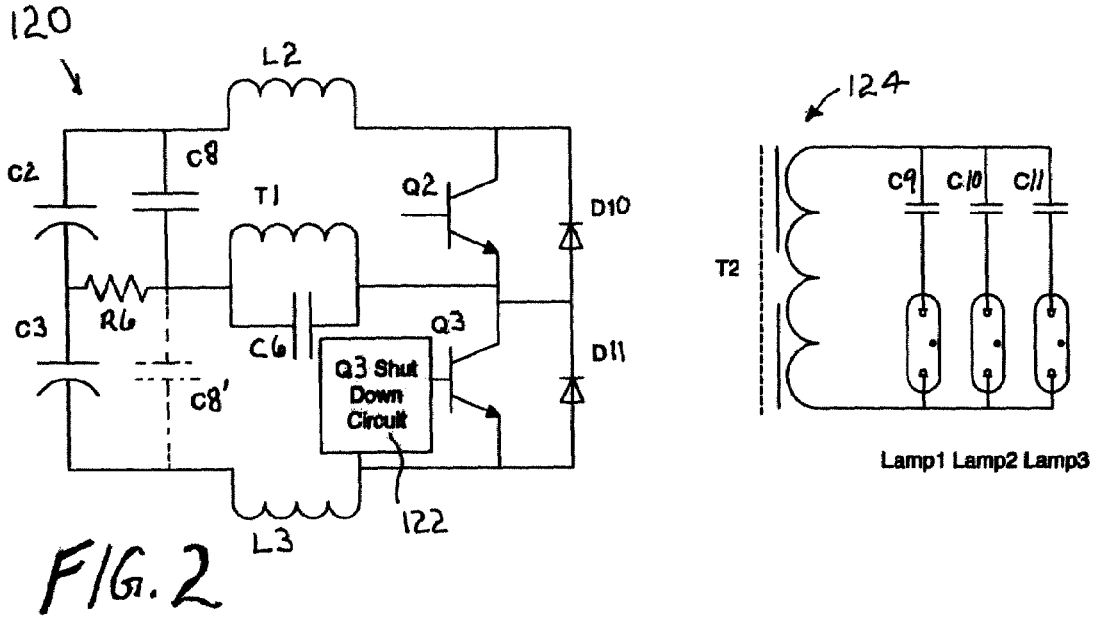
FIG. 2 illustrates a simplified circuit similar to that of FIG. 1, including a duty cycle dependent capacitor and balancing resistor.

Turning to FIG. 2, illustrated is a simplified circuit 120 of the preceding circuit, including newly-implemented concepts of the present application. In FIG. 2, components previously called out have similar designations. Circuitry not needed for the description of this portion of the current fed ballast is not provided for clarity reasons. For example, for simplicity, the shutdown circuit used to shut down BJT switch Q3, is shown as shutdown circuit block 122.

Newly added components, which are implemented to eliminate DC bias within circuit 120 include a duty cycle dependent capacitor C8 and a balancing/charging resistor R6. Duty cycle dependent capacitor C8' is provided in dotted connection illustrating an alternative embodiment for eliminating the DC bias. Diodes, D10 and D11, are considered to have been included in the previously described circuits. However, in those circuits, they may be understood to have been incorporated within the BJT switches Q2, Q3. Here they are shown external to the transistors.

FIG. 2 also shows a lamp system 124 including a secondary winding T2 to primary winding T1, as well as capacitors C9, C10, C11, placed in series with lamps Lamp 1, Lamp 2 and Lamp 3, respectively.

The circuit design of FIG. 2, is intended to address issues which may occur due to implementation of the previously-described ballast configurations, which include low-cost shutdown circuits. As identified in FIG. 2, the shutdown control circuitry 122 is implemented in conjunction with only a single one of switches Q2 and Q3—in this instance Q3. An issue which may arise due to the shutdown control circuit only being associated with one of BJT switches Q2, Q3, is that if a complete turnoff of the BJT does not occur in a short time interval, an imbalance on one of electrolytic capacitors C2, C3 occurs. As a result of this imbalance, one of the two series electrolytic capacitors C2, C3 may be subject to an overvoltage condition leading to the failure of one of the capacitors. The voltage rating of capacitors C2 and C3 is well below the maximum bus voltage of the ballast 120.

In order to address this potential situation, FIG. 2 illustrates the inclusion of duty-cycle dependent capacitor C8 connected in series with a resonant circuit of the ballast, which includes the primary winding T1 and resonant capacitor C6. By this arrangement, during shutdown of the ballast, and in the event the selected switch (e.g., Q3) does not shut down in a short enough time period, the imbalance in the load between capacitors C2 and C3 is shifted to duty cycle dependent capacitor C8. More particularly, C8 is provided at a voltage value rated to at least the bus voltage of the ballast, thereby obviating overvoltage issues. Further, by reducing the voltage on the capacitor (in this case C8), the shutdown of the inverter will be accelerated without overstressing electrolytic capacitors C2, C3.

Balancing/charging resistor R6 is provided to allow the balance of charge to be maintained on capacitors C2 and C3, and to also aid in charging of duty cycle dependent capacitor C8 to the midpoint of the bus voltage prior to the start of the oscillation of the inverter system, which sets the initial state of the inverter.

With continuing attention to FIG. 2, circuit 120 is particularly useful to eliminate unbalanced DC situations during shutdown operation of the ballast, such as but not limited to times when the shutdown is occurring at high temperatures, which is a particular situation where such undesirable imbalance may occur.

Typically, during normal operation, which means, for example, a 50/50 duty cycle between switches Q2 and Q3, the maximum voltage on electrolytic capacitors C2 and C3 will be half of the bus voltage. For example, if the bus voltage is 450 volts, capacitor C2 will have a approximately 225 volts, and capacitor C3 will also have a 225 volts. Of course, these values are simply examples, and other bus voltages may be used dependent upon the particular implementations.

Again, as shutdown circuit 122 of this implementation is only associated with one of switches Q2, Q3, the shutdown period may result in changing the on/off times of Q2 and Q3 to be other than at the 50 percent duty cycle. Rather, when attempting to, for example, shut down Q3, prior to the complete shutdown, Q3 may operate at less than 50 percent of the duty cycle. This results in switch Q2 operating at more than 50% of the duty cycle. Of course, these two duty cycles will add up to the 100 percent duty cycle. However, with switch Q2 on for a longer part of the duty cycle, capacitor C3 will charge up for a longer time period, since the charge-up of capacitors C2 and C3 are based on the duty cycles of switches Q2 and Q3. At some point during the shutdown operation, this un-equal duty cycle of switches Q2, Q3 may result in capacitor C3 seeing the entire bus voltage and therefore it will try to charge up to the bus voltage. This causes C3 to become overstressed, and may result in failure and/or damage to the ballast.

As summarized above, in order to address this situation, duty-cycle dependent capacitor C8 and balancing/charging resistor R6 are added to the circuit. During normal running, capacitor C8 will have half of the bus voltage charge impressed upon it, due to its position in the circuit. When, however, the ballast enters shutdown operation and the duty cycles become unbalanced, the charge on capacitor C8 will begin to reduce, allowing the charge on capacitors C2 and C3 to remain balanced. Particularly, due to the charge on capacitors C2 and C3, there is high impedance path through R6, which therefore causes the circuit to act as if C8 is not connected to C2 and C3 due to the time constant. By this design, all the voltage induced stress, at this point, has been taken over by capacitor C8, which is rated to the bus voltage.

Also, as capacitor C8 is discharging through T1 and C6 and there is less and less voltage on capacitor C8 (this is occurring when Q2 is turning on), there is less energy available to sustain the "on" state of Q2. Thus, this design also helps in turning off the ballast, resulting in a quicker shutdown than previous arrangements. Therefore, the addition of capacitor C8 provides a solution to the unbiased DC previously occurring in certain situations and decreases the turn-off time of the ballast.

However, addition of capacitor C8 introduces an issue related to initial turn-on of the ballast when oscillations are just starting. Particularly, if without balancing/charging resistor R6, and C8 voltage is very low during the start-up, circuit 120 is maintained on for Q3 for a much longer time duration. Therefore, the ballast is unbalanced at start-up, which means that over many starts Q3 is subject to failure. Balancing/charging resistor R6 is connected between C2 and C3 on one side, and between C8, C6 and T1 on its other side to address this issue. By this arrangement, prior to circuit oscillation, resistor R6 is used to charge capacitor C8 up to the half-bus voltage. For example, as charge is stored on C2 and C3, there is also a path from C3 through resistor R6 to capacitor C8, which charges capacitor C8 up to the half-bus voltage level. This will need a slight oscillation delay to allow C8 to charge-up to the half-bus voltage. In one embodiment, a ratio between one of the electrolytic capacitors (C2, C3) and duty cycle dependent capacitor (C8 or Ci') is in the range of 50~600.

As R6 is a large value compared to C2 or C3, the RC time constant is fairly large. So during shutdown, R6 provides isolation between C8 as to C2 and C3.

While the component values for the circuits of the present application may be selected, dependent upon the various implementations, in at least one embodiment the capacitors C2 and C3 may be approximately 47 micro-fared capacitors, with resistor R6 being approximately a one-half mega-ohm resistor. This results generally in a time constant of approximately 23 seconds during inverter shutdown. The time constant between capacitor C8 and resistor R6 is much smaller, and may be approximately a 25-100 millisecond time constant and more particularly a 75 millisecond time constant during start-up. So the charge-up time is very fast during start-up of the ballast system.

With continuing attention to FIG. 2, the circuit as described above may be implemented in alternative embodiments. For example, duty cycle dependent capacitor C8', shown in dotted line, represents an embodiment where capacitor C8' is used in place of capacitor C8. Also, the shutdown circuit 122 shown on switch Q3 can also be, of course, on switch Q2. Still further, while a half-bridge switching arrangement is shown, a full-bridge BJT switching system may also benefit from the concepts described herein.

Thus, by implementing a circuit design including capacitor C8 and resistor R6, the issues of unbalanced duty cycles during shutdown causing unbalanced DC bias on capacitors C2 and C3 is addressed, as well as eliminating issues regarding start-up.

To initiate a shutdown of the ballast, shutdown circuit 122 will normally receive a shutdown instruction which has, for example, been described in U.S. patent application Ser. No. 11/645,939, incorporated herein in its entirety.

Figure 3:
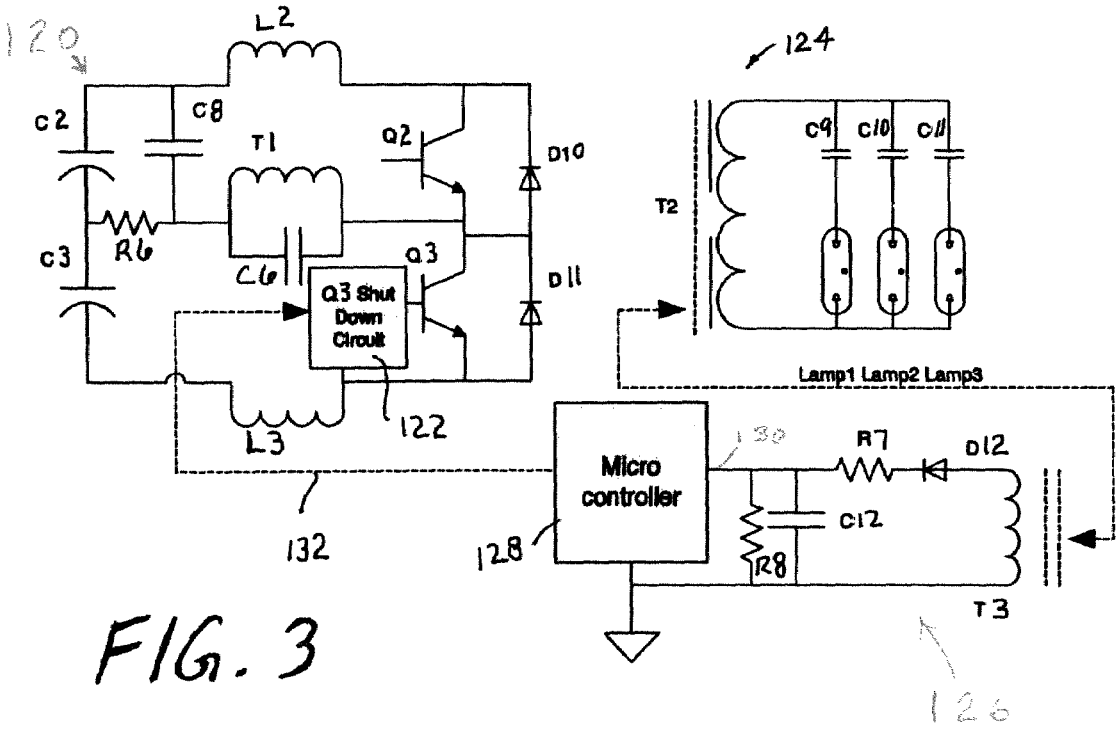
FIG. 3 depicts the concepts of FIG. 2, and further illustrates an inverter shutdown detection circuit.

Turning to FIG. 3, provided is an improvement to circuit 120 which will detect whether the shutdown operation has been completed, or if another shutdown instruction needs to be issued to shutdown circuit 122. In this illustration C8' is not shown for convenience. Particularly, in this embodiment a shutdown detection circuit 126 is provided, which includes winding T-3 placed in operational coupling with secondary winding T2 of lamp system 124. Once shutdown circuit 122 has initiated a shutdown operation, micro-controller 128 of detection circuit 126 is configured to, after a time delay, sense for a voltage at node 1130 to determine whether the value at node 1 is 0 volts or some other non-zero voltage value. In operation, a voltage is placed at node 1 through winding T3, which passes any voltage on winding T2. If a voltage is detected at T2, it is passed through diode D12, R7 and R8, where R7 and R8 form a divider circuit. Capacitor C12 is placed in parallel with resistor R8 to store voltage. Essentially, if node 1 is determined to have a 0 value, then shutdown of the ballast is complete, as no energy has been detected at winding T2. On the other hand, if a voltage is found at node 1, micro-controller 128 will send a second shutdown signal via line 132 to the shutdown circuit 122. It is understood line 132 may be any known manner of transmitting signals.

The invention has been described with reference to the preferred embodiments. Obviously, modifications and alterations will occur to others upon reading and understanding the preceding detailed description. It is intended that the invention be construed as including all such modifications and alterations.

What is claimed is:

1. A system that eliminates DC bias on at least one of a first electrolytic capacitor and a second electrolytic capacitor of a bipolar junction transistor based inverter ballast having a shutdown control circuit optionally associated with only one of at least two bipolar switches, the system comprising:

a duty cycle dependent capacitor connected in series with a bus of the ballast and a resonant circuit including a inductor winding and a resonant capacitor;

a balancing/charging resistor connected at one end between the first electrolytic capacitor and the second electrolytic capacitor and at another end to the duty cycle dependent capacitor and the resonant circuit.

2. The system according to claim 1, wherein the duty cycle dependent capacitor is configured and positioned to shift an imbalance in a voltage on the first electrolytic capacitor and the second electrolytic capacitor that can occur upon shutdown of the ballast.

3. The system according to claim 1, wherein a voltage rating of the duty cycle dependent capacitor is at least as great as a maximum bus voltage of the ballast.

4. The system according to claim 1, wherein the balancing/charging resistor is configured to allow charge to charge up the duty cycle dependent capacitor to a voltage value on at least one of the electrolytic capacitors.

5. The system according to claim 1, including a shutdown detecting circuit configured to detect a signal at a winding of one of the ballast or a lighting system and configured to supply a shutdown signal to the shutdown control circuit.

6. The system according to claim 1, wherein a ratio between one of the electrolytic capacitors and the duty cycle dependent capacitor is in the range of 50~600.

7. The system according to claim 1, wherein the ratio between one of the electrolytic capacitors and the duty cycle dependent capacitor is approximately 470.

8. The system according to claim 1, wherein the time constant between the duty cycle dependent capacitor and the balancing/charging capacitor is in the range of 25 milliseconds and 100 milliseconds.

9. The system according to claim 1, wherein the time constant between the duty cycle dependent capacitor and the balancing/charging capacitor is in the range of 25 milliseconds and 75 milliseconds.

10. A method of eliminating DC bias on at least one of a first electrolytic capacitor and a second electrolytic capacitor of a bipolar junction transistor based inverter ballast having a shutdown control circuit on only one of at least two bipolar switches, the method comprising:

starting shut down of the inverter ballast; and shifting voltage imbalance from at least one of the electrolytic capacitors to a duty cycle dependent capacitor connected in series with a bus of the ballast and a resonant circuit including a transformer winding and a resonant capacitor.

11. The method according to claim 10, further including accelerating the shutdown of the inverter ballast by shifting voltage to the duty cycle dependent capacitor.

12. The method according to claim 10, further including charging the duty cycle dependent capacitor by a balancing/charging resistor connected at one end between the first electrolytic capacitor and the second electrolytic capacitor and at another end to the duty cycle dependent capacitor and then resonant circuit prior to start-up of the inverter ballast.

13. The method according to claim 10, wherein a voltage rating of the duty cycle dependent capacitor is at least as great as a maximum bus voltage of the ballast.

14. The system according to claim 10, including a shutdown detecting circuit configured to detect a signal at a winding of one of the ballast or a lighting system and configured to supply a shutdown signal to the shutdown control circuit.

* * * * *